US005466203A

United States Patent [19]

Chen

[11] Patent Number: 5,466,203

[45] Date of Patent: Nov. 14, 1995

[54] MAGNETICALLY CONTROLLED LOAD ADJUSTING STRUCTURE OF GYMNASTIC APPARATUS

[76] Inventor: George Chen, No. 20, Lane 1265, Chung Cheng Road, Wu Feng, Taichung, Taiwan

[21] Appl. No.: 219,889

[22] Filed: Mar. 30, 1994

[51] Int. Cl.[6] ..... A63B 69/16; A63B 21/24

[52] U.S. Cl. ..... 482/63; 482/57; 482/903

[58] Field of Search ..... 482/63–65, 903, 482/56, 51–53, 903; 74/96

[56] References Cited

U.S. PATENT DOCUMENTS

| | | | |
|---|---|---|---|
| 2,019,224 | 10/1935 | Hess | 482/63 |
| 3,024,023 | 3/1962 | Stoller | 482/63 |
| 3,833,216 | 9/1974 | Philbin | 482/64 |
| 4,298,893 | 11/1981 | Holmes | 482/63 |
| 4,752,066 | 6/1988 | Housayama | 482/63 |
| 4,822,032 | 4/1989 | Whitmore et al. | 482/63 |
| 4,838,544 | 6/1989 | Sasakawa et al. | 482/65 |
| 5,031,901 | 7/1991 | Saarinen | 482/63 |
| 5,094,447 | 3/1992 | Wang | 482/63 |
| 5,236,069 | 8/1993 | Peng | 482/63 |
| 5,310,392 | 5/1994 | Lo | 482/63 |

*Primary Examiner*—Jerome W. Donnelly
*Attorney, Agent, or Firm*—Browdy and Neimark

[57] ABSTRACT

A magnetically controlled load-adjusting device of a gymnastic apparatus comprises a frame provided with a load wheel having a thin metal piece, and a base frame having one end provided pivotally with a swivel seat. The base frame has another end provided with a decelerating mechanism. The base frame is provided in the middle thereof with an arresting member which is connected at one end thereof with the swivel seat and is capable of being acted on by an elastic element to become attached intimately to the circumferential surface of an eccentric wheel of the decelerating mechanism. The distance between the arresting member and the axial center of the eccentric wheel is changed by the decelerating mechanism, so as to cause the swivel seat to swivel at an appropriate angle. The magnitude of the magnetic flux of the load wheel is therefore altered by the magnets mounted on the swivel seat, thereby bringing about an adjustment of the magnitude of the magnetic damping of the gymnastic apparatus.

3 Claims, 5 Drawing Sheets

MAGNETICALLY CONTROLLED LOAD ADJUSTING STRUCTURE OF GYMNASTIC APPARATUS

FIELD OF THE INVENTION

The present invention relates generally to a gymnastic apparatus, and more particularly to a magnetically controlled load-adjusting structure of the gymnastic apparatus.

BACKGROUND OF THE INVENTION

The conventional gymnastic apparatus capable of animating a bicycle riding is generally provided with a load adjusting device for increasing or decreasing the magnitude of damping of the rotating wheel. The above-mentioned load adjusting device is generally operated on the mechanical friction or the magnetic damping which is relatively compact and is therefore widely used.

The conventional magnetic damping device comprises a nonmagnetic thin copper piece provided with a U-shaped magnet having thereon a retaining plate which can be located by a retaining device. The retaining plate is further provided with a plurality of retaining teeth. The retaining plate is capable of being actuated by the two cables to rotate. These two cables can be caused to change their relative positions by the rotation of an adjustment button. As the retaining teeth and the retaining device are adjustably engageable at different angles, the U-shaped magnet is caused to bring about the different braking damping effects relative to the thin copper piece. The magnitude of the magnetic damping of the conventional magnetic damping device is dependent on the tooth pitch and the number of teeth of the retaining teeth. As a result, the magnetic damping value of the conventional magnetic damping device is changed in a step-by-step manner. In addition, the retaining teeth and the retaining device of the conventional magnetic damping device are vulnerable to a deadlock caused by an excessively forceful rotation of the addjustment button. Moreover, the efficiency of the gymnastic apparatus is often compromised by the magnet of the conventional magnetic damping device, which can not be automatically controlled in conjunction with the operation of the motor of the gymnastic apparatus.

SUMMARY OF THE INVENTION

It is therefore the primary objective of the present invention to provide a magnetically controlled load-adjusting device, which is simple in construction and can be assembled easily. In addition, the adjustment of the magnetic damping value of the device of the present invention can be changed in a stepless fashion.

It is another objective of the present invention to provide a magnetically controlled load-adjusting device capable of preventing the braking element from moving sideways to become inoperative.

The foregoing objectives of the present invention are attained by the magnetically controlled load-adjusting means, which comprises a frame provided with a load wheel having a thin metal piece, and a base frame having one end provided pivotally with a swivel seat. The base frame has another end provided with a decelerating mechanism (sometimes hereinafter referred to as a "drive mechanism"). The base frame is provided in the middle thereof with an arresting member which is connected at one end thereof with the swivel seat and is capable of being acted on by an elastic element to become attached intimately to the circumferential surface of an eccentric wheel of the drive or mechanism. The distance between the arresting member and the axial center of the eccentric wheel is changed by the rotation of the eccentric wheel driven by the drive or mechanism, so as to cause the swivel seat to swivel at an appropriate angle. As a result, the magnitude of the magnetic flux of the load wheel is altered by the magnets mounted on the swivel seat, thereby bringing about an adjustment of the magnitude of the magnetic damping of the gymnastic apparatus.

DETAILED DESCRIPTION OF THE INVENTION

Figure 1:
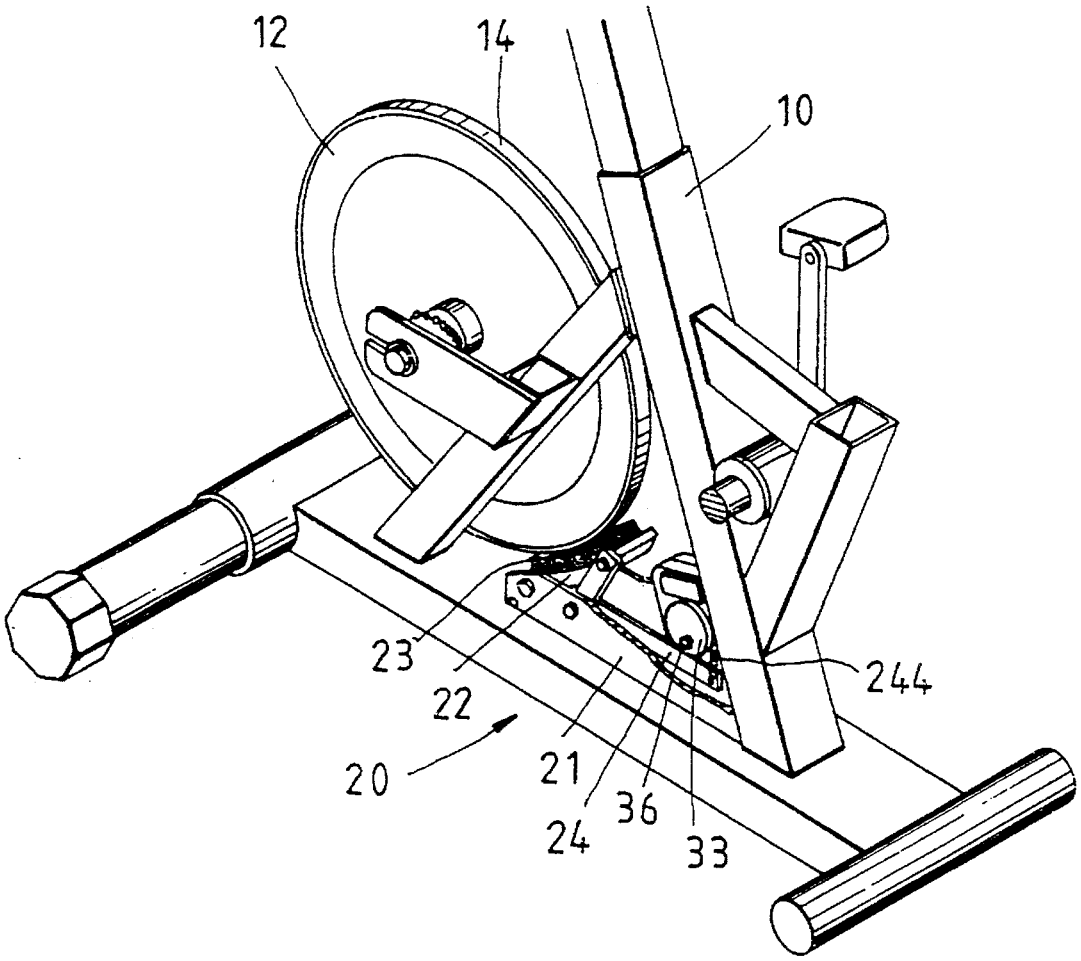
FIG. 1 shows a perspective view of a first preferred embodiment of the present invention.
Figure 2:
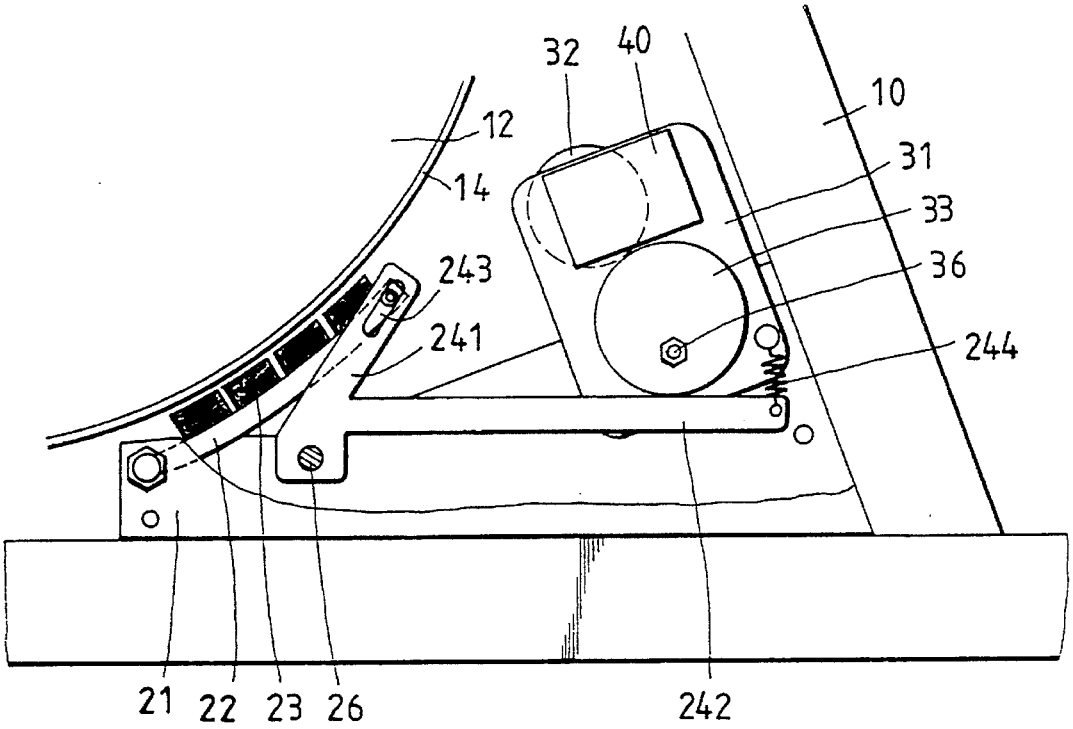
FIG. 2 shows a schematic view of the first preferred embodiment in action, according to the present invention.
Figure 3:
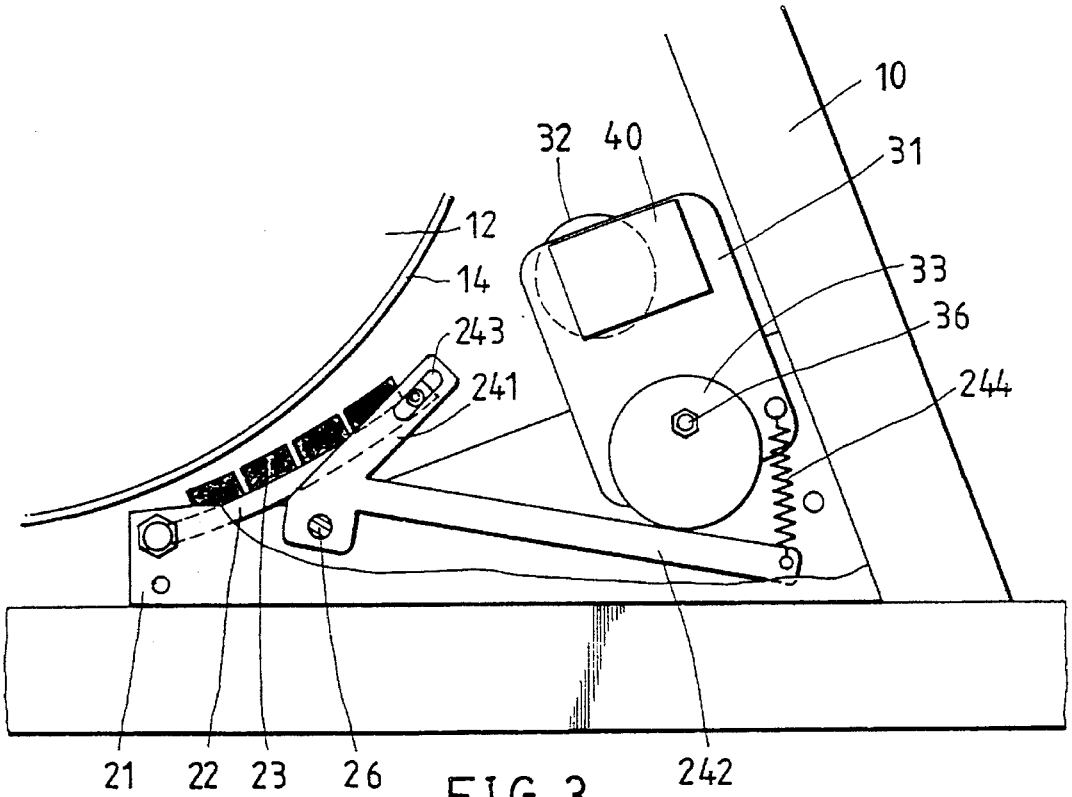
FIG. 3 shows another schematic view of the first preferred embodiment in action, according to the present invention.

As shown in FIGS. 1–3, a magnetically controlled load-adjusting structure of a gymnastic apparatus of the present invention comprises a frame 10 provided with a load wheel 12 having on the circumferential surface thereof a thin copper piece 14. The frame 10 is further provided thereon with a load control device 20 comprising a base frame 21 provided on one side thereof with a drive or decelerating mechanism 30 comprising a housing 31. Located at the outside of the housing 31 is a motor 32 capable of actuating a plurality of gears (not shown in the drawing) housed in the housing 31. These gears are intended to drive an eccentric wheel 33 at an appropriate decelerating ratio. The load wheel 12 is provided pivotally at one side thereof with a swivel seat 22 having a radian similar to that of the load wheel 12. The swivel seat 22 is provided with a predetermined number of magnets 23 opposite in location to the outer circumferential fringe of the load wheel 12.

The load control device 20 is further provided with a rocking arm 24 serving as an arresting member. The rocking arm 24 is pivoted to the base frame 21 by a pivoting element 26. The rocking arm 24 has a first support arm 241 extending upwards and second support arm 242 extending sideways. The first and the second support arms 241 and 242 form a predetermined angle. The first support arm 241 is provided with a slide slot 243 of an oblong construction and is pivoted to one end of the swivel seat 22 by means of a pivoting element. The second support arm 242 is connected at one end thereof with a spring 244 having another end that is connected with the housing 31 of the decelerating mechanism 30. The second support arm 242 can be caused by the spring 244 to urge intimately the circumferential surface of the eccentric wheel 33 of the decelerating mechanism 30. A circuit board 40 is mounted on one side of the housing 31 of the decelerating mechanism 30 and is provided thereon with such detecting elements as control circuits, switches, photoelectric members, etc. The detecting elements are used in controlling the operation of the motor 32 which drives the eccentric wheel 33.

The operation of the magnetically controlled load-adjusting device 20 of the present invention is described in detail hereinafter.

The eccentric wheel 33 of the drive mechanism 30 of the present invention is driven at an appropriate decelerating ratio by the motor 32 of the drive or decelerating mechanism 30. The eccentric wheel 32 has an axial center 36. As the circumferential surface of the eccentric wheel 33 is urged by the second support arm 242 of the rocking arm 24, the swivel seat 22 is caused to swivel at an appropriate angle. In other words, when the circumferential surface nearest the axial center 36 of the eccentric wheel 33 is urged by the second support arm 242, the position of the swivel seat 22 is such that the magnets 23 mounted on the swivel seat 22 are closest to the load wheel 12, as shown in FIG. 2. As a result, the magnetic flux of the thin copper piece 14, which is acted on by the magnets 23, reaches a maximum. In other words, the load damping which acts on the load wheel 12 is caused to reach a maximum.

When the eccentric wheel 33 is driven by the decelerating mechanism 30 to turn, the distance between the axial center 36 of the eccentric wheel 33 and the second support arm 242 becomes greater in view of the fact that the eccentric wheel 33 is caused to swivel at a greater angle. In other words, the swivel seat 22 is caused by the rocking arm 24 to swivel downwards, thereby resulting in a reduction in the magnetic flux of the thin copper piece 14 which is acted on by the magnets 23 mounted on the swivel seat 22. The load damping which acts on the load wheel 12 is therefore reduced. When the circumferential surface farthest the axial center 36 of the eccentric wheel 33 is urged by the second support arm 242, the position of the swivel seat 22 is such that the gap between the magnets 23 and the thin copper piece 14 is greatest, as shown in FIG. 3. As a result, the load damping which acts on the load wheel 12 is smallest. In short, the present invention makes use of a circuit board 40 provided with photoelectric elements and switches to control the motor 32 which drives the eccentric wheel 33, so as to cause a change in the magnitude of the magnetic flux of the thin copper piece 14 of the load wheel 12. Accordingly, the magnitude of the load damping which works on the load wheel 12 is caused to change by a change in the position of the swivel seat 22.

Figure 4:
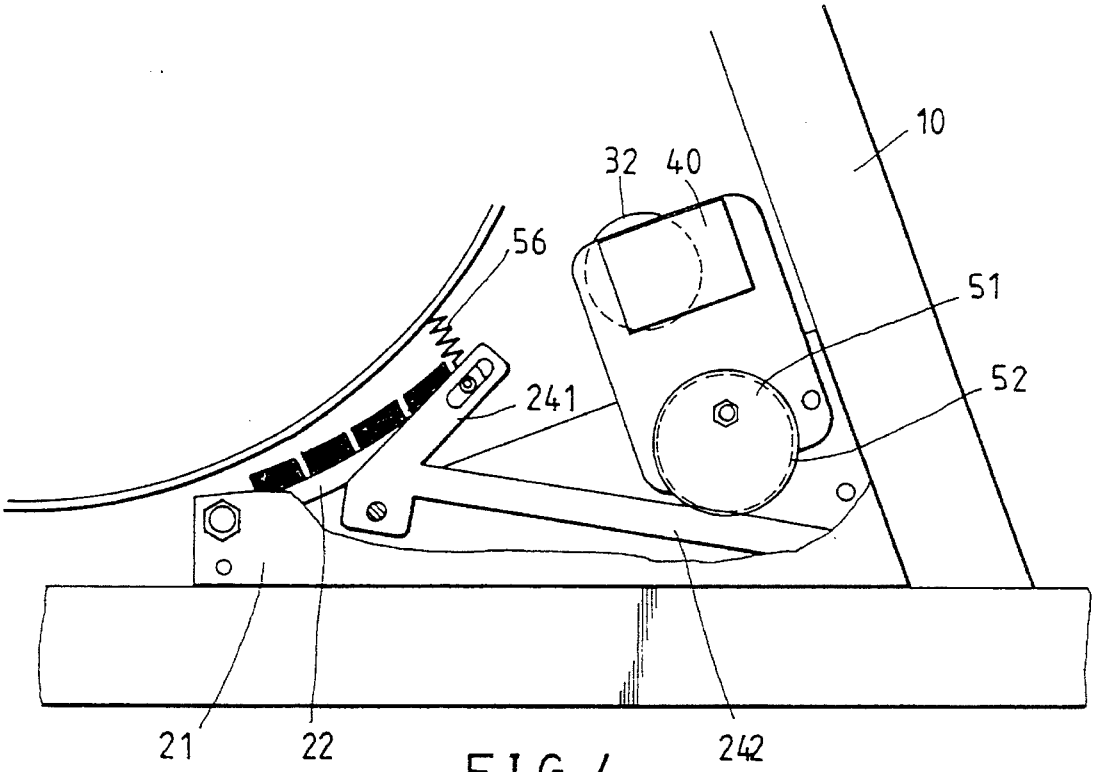
FIG. 4 shows a schematic view of a second preferred embodiment at work, according to the present invention.

As shown in FIG. 4, the second preferred embodiment of the present invention comprises a decelerating mechanism 50 provided with an eccentric wheel 51 having in the circumferential surface thereof a guide slot 52 dimensioned to receive therein the second support arm 242 of the rocking arm 24. Such a design as described above is intended to enable the second support arm 242 to urge the eccentric wheel 51 securely so as to enable the load damping to be adjusted with precision. In addition, a spring 53 is disposed between the frame 10 and the swivel seat 22 such that the spring 53 is able to cause the second support arm 242 to urge intimately the eccentric wheel 51.

Figure 5:
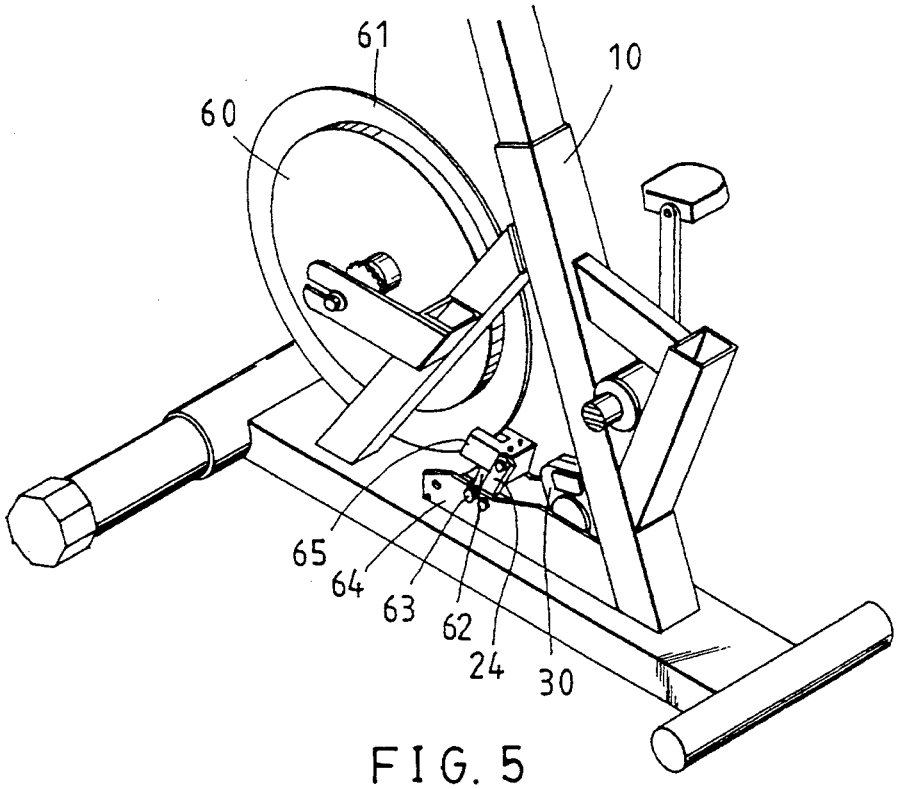
FIG. 5 shows a perspective view of a third preferred embodiment of the present invention.

Now referring to FIG. 5, the third preferred embodiment of the present invention is shown to comprise a load wheel 54 provided on the circumferential surface thereof with a thin round piece 55, and a swivel seat 56 pivoted to a base frame 58 by a rotary shaft 57. Fastened by a screw to the swivel seat 56 is a U-shaped magnet 59, which embraces the thin round piece 55 without making contact with the thin round piece 55. The magnetically controlled load-adjusting principle of the third preferred embodiment of the present invention is basically similar to that of the first preferred embodiment described above, with the difference being the magnetic damping structure between the swivel seat 56 and the load wheel 54 of the third preferred embodiment.

Figure 6:
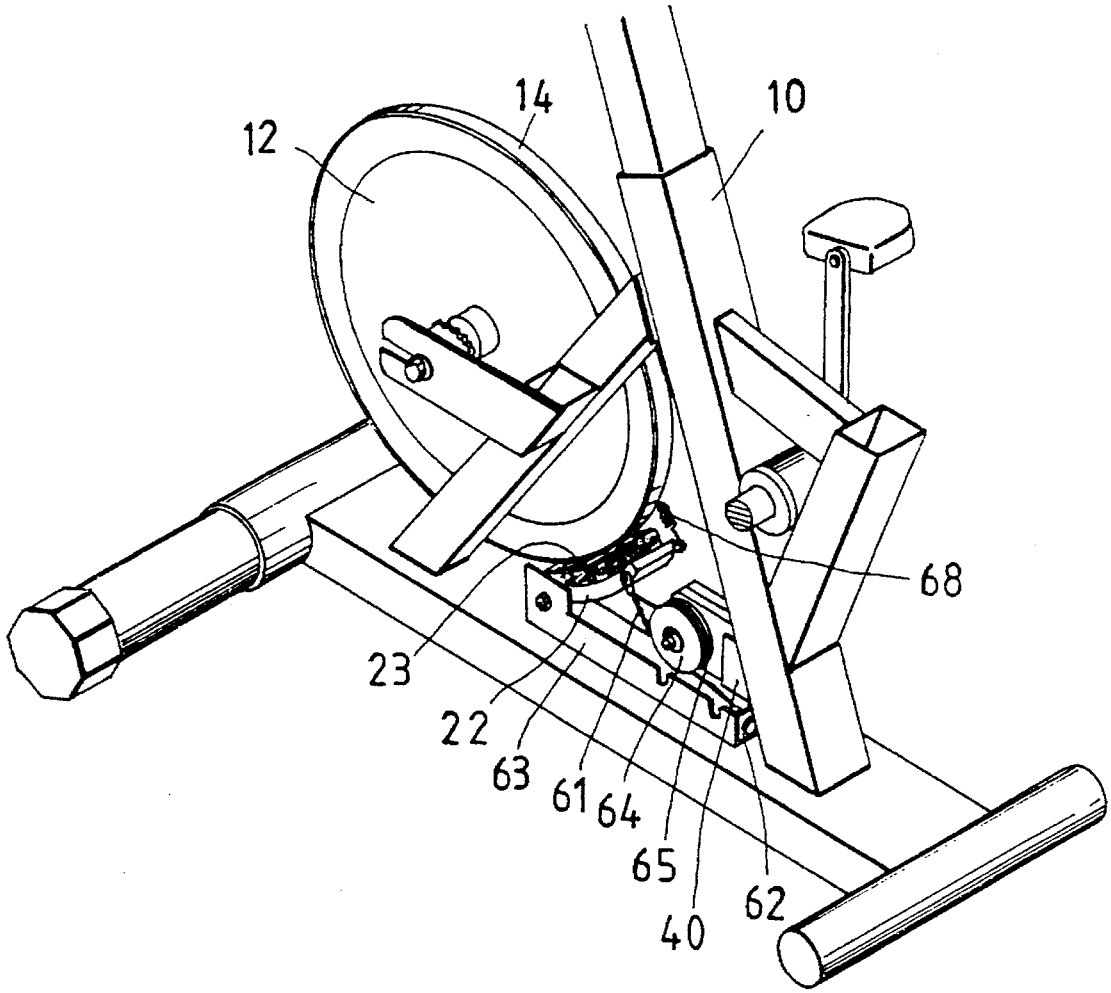
FIG. 6 shows a perspective view of a fourth preferred embodiment of the present invention.
Figure 7:
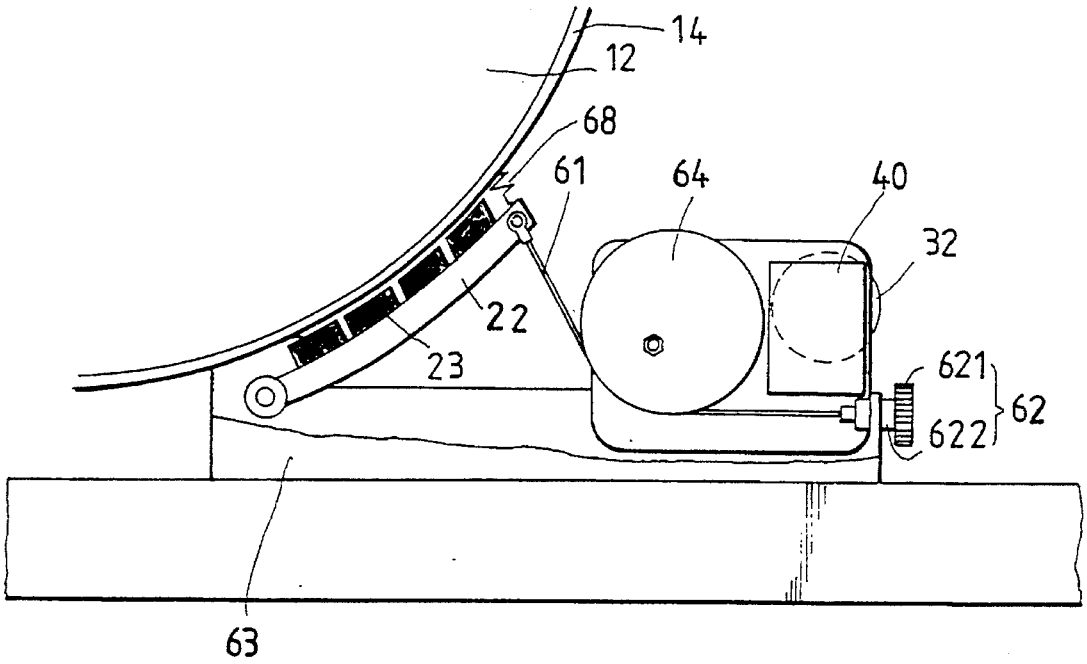
FIG. 7 shows a schematic view of the fourth preferred embodiment in action, according to the present invention.
Figure 8:
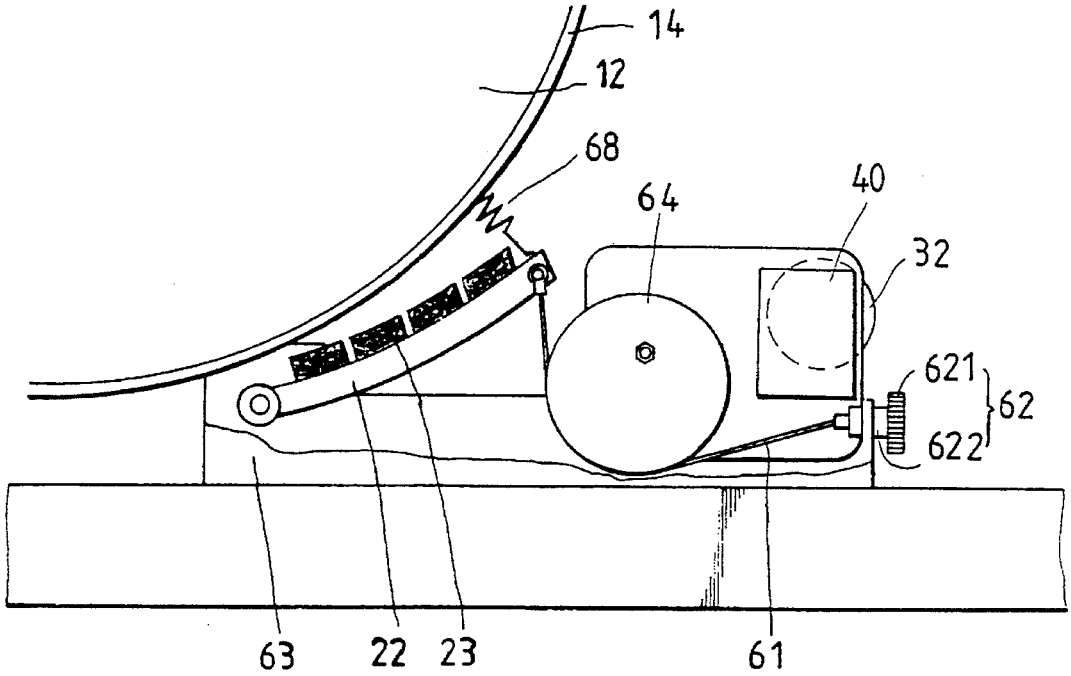
FIG. 8 shows another schematic view of the fourth preferred embodiment in action, according to the present invention.

As shown in FIGS. 6–8, the fourth preferred embodiment of the present invention has a swivel seat 22 provided with a rope 61 as a braking member. The rope 61 has one end that is fastened to the swivel seat 22 and another end that is connected by means of an adjustment member 62 with one end of a base frame 63. The adjustment member 62 is made up of a bolt 621 and a nut 622 which is fastened to the base frame 63. The rope 61 is fastened to the tail end of the bolt 621 such that the rope 61 is received in a guide groove 65 of an eccentric wheel 64. The rope 61 is basically similar in function to the rocking arm 24 of the first preferred embodiment of the present invention. In other words, the swivel seat 22 is caused to swivel at an appropriate angle by the rope 61 in conjunction with the eccentric wheel 64, thereby resulting in a change in the magnetic flux of the thin copper piece 14 acted on by the magnets 23 of the swivel seat 22. Accordingly, the magnitude of the load damping, which acts on the load wheel 12, can be changed.

The fourth preferred embodiment of the present invention is further provided with a spring 68 having one end that is fastened to the upper end of the swivel seat 22 and another end that is fastened with the frame 10. The spring 68 is intended to prevent the swivel seat 22 from being caused by its own weight and the vibration of the frame 10 to move downwards at such time when the swivel seat 22 is so located that the swivel seat 22 is acted on by the smallest load damping. When the circumferential surface farthest from the axial center of the eccentric wheel 64 is urged by the rope 61, the swivel seat 22 is prevented from being caused by the vibration of the frame 10 to swing downwards, thanks to the spring 68 which upholds the swivel seat 22. In addition, the gap between the swivel seat 22 and the load wheel 12 can be adjusted minutely by means of the bolt 622 of the adjustment member 62 which is connected with the rope 61 and the base frame 21. As a result, the maximum magnetically controlled damping of the gymnastic apparatus of the present invention can be changed minutely.

It must be noted here that the design of the present invention is such that the load wheel can not be obstructed in any way by the swivel seat by virtue of the fact that the swivel seat is confined to swivel within a deflection angle even at such time when the eccentric wheel is driven to rotate by an abnormally-operating motor.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A magnetically controlled load-adjusting means of a gymnastic apparatus comprising:

a load wheel having a circumferential surface, said wheel being mounted on a frame of a gymnastic apparatus, said circumferential surface of said load wheel having a thin metal piece fastened thereto;

a base frame having a first end and a second end, said frame being mounted on said frame of said gymnastic apparatus;

a swivel seat having a first end and a second end, said swivel seat having a first end being pivotally mounted to said base frame, an arresting means including a rocking arm, said rocking arm being pivotally attached to said base frame, said rocking arm further including a first support arm and a second support arm, said first support arm being pivotally attached to a second end of said swivel seat;

an elastic element;

a drive mechanism;

a wheel eccentrically mounted to said drive mechanism, wherein tension is applied to said second support arm by said elastic element, to urge said second support arm against said circumferential surface of said eccentrically mounted wheel, said eccentrically mounted wheel being driven by said drive mechanism so as to change a distance between said arresting means and the axial center of said eccentric wheel for angularly pivoting said swivel seat about its first end, thereby resulting in a change in a magnetic flux of said load wheel so as to bring about a change in a magnetic flux, being the component of a magnetic field arising from a magnetic means mounted on said swivel seat.

2. The magnetically controlled load-adjusting means of claim 1 wherein said elastic element is a spring having one end fastened to said drive mechanism and another end fastened to said second support arm of said rocking arm.

3. The magnetically controlled load-adjusting means of claim 1 wherein said circumferential surface of said eccentric wheel is provided with a guide groove which encircles said circumferential surface and is dimensioned to receive therein said arresting means.

* * * * *